US005085008A

United States Patent [19]

Jennings et al.

[11] Patent Number: 5,085,008

[45] Date of Patent: Feb. 4, 1992

[54] APPARATUS AND METHOD FOR CUTTING AND GRINDING MASONRY UNITS

[75] Inventors: Gilbert M. Jennings, St. George; Scott Gledhill, Salt Lake City; Norman R. Stock, St. George; Arthur T. Powell, Lehi, all of Utah

[73] Assignee: Versicut, Ltd., St. George, Utah

[21] Appl. No.: 480,244

[22] Filed: Feb. 15, 1990

[51] Int. Cl.[5] ..... B24B 7/00

[52] U.S. Cl. ..... 51/74 R; 51/76 R; 125/12; 125/13.01

[58] Field of Search ..... 125/12, 13.01; 51/74 R, 51/76 R, 78, 102; 248/230, 295.1

[56] References Cited

U.S. PATENT DOCUMENTS

| | | | |
|---|---|---|---|
| 2,178,491 | 10/1939 | Palotce | 51/206 P |
| 2,516,840 | 8/1950 | Allen, Jr. et al. | 51/273 |
| 2,554,079 | 5/1951 | Wilson | 51/76 R |
| 2,804,723 | 9/1957 | Sweeney | 51/76 R |
| 2,925,691 | 2/1960 | Kibble | 51/76 R |
| 3,220,146 | 11/1965 | Ross | 51/78 |
| 3,447,268 | 6/1969 | Scott | 51/74 R |
| 3,851,854 | 12/1974 | Roybal | 254/7 C |
| 4,708,309 | 11/1987 | Walter | 248/295.1 |

*Primary Examiner*—M. Rachuba

*Attorney, Agent, or Firm*—Workman, Nydegger & Jensen

[57] ABSTRACT

A production line, continuous feed, high volume output apparatus for cutting, grinding, and/or polishing concrete or fired masonry units into finished masonry building materials. A conveyor belt moves the masonry units from an input station through a processing station where the masonry units are subjected to abrasion treatment by a rotating working head. The working head may take the form of saw blades or one or more horizontal cylindrical drums disposed above the conveyor path with the axis of the horizontal cylindrical drums normal to the conveyor path. The height of the working head above the conveyor path is adjustable. In the drum form of the working head, an abrasive, such as synthetic diamonds is mounted in a matrix in a spiral array. Lateral movement of the masonry units off of the conveyor path is restrained by adjustable guide rails. During abrasion treatment the position of the masonry units on the moving conveyor belt is additionally sustained by horizontal rollers spring-biased downwardly onto the tops of the masonry units from the tray to which the working head is rotatably mounted. Optionally, vertical rollers spring-biased horizontally against the sides of the masonry units also sustain the masonry units during abrasion treatment. A fluid under pressure is used to evacuate dust, cuttings, and heat from the working head and the finished masonry units.

61 Claims, 7 Drawing Sheets

APPARATUS AND METHOD FOR CUTTING AND GRINDING MASONRY UNITS

BACKGROUND

1. Field of the Invention

This invention pertains to apparatus and methods for producing finished masonry building materials from masonry units of either the concrete or fired varieties. More particularly, the present invention relates to an apparatus and method for subjecting such masonry units to abrasion treatment in order to produce therefrom finished masonry building materials of a predetermined size and surface finish quality.

2. Background Art

It is common in building construction to employ both fired and concrete masonry units. The latter are comprised of an aggregate, such as cinders, gravel, or sand held together by a binder, such as cement. The cinders often used in such concrete masonry units can be either man-made or volcanic in origin. The use of cinders as aggregate initially led to such blocks being referred to as "cinder blocks." The manufacture of concrete masonry units typically involves the pressurized extrusion of a slightly moist mix of aggregate and binder from a mold, followed by curing.

Initially, concrete masonry units were coarse in appearance and bore drab colors that have become associated with industrial settings. Thus, while concrete masonry units were also employed in residential and commercial locations, their appearance dictated that they be used only in unexposed walls.

Such construction materials when artfully fabricated, however, offer greater potential as attractive constituents of exposed walls. Colors can be added to the cement binder of the aggregate to produce concrete masonry units in a variety of hues. For example, iron oxide is utilized in this role to produce a concrete masonry block giving the appearance of red sandstone. In addition, it is possible to vary the color, size and density of the aggregate particles that are sustained by the binder. By using these devices some degree of variety can be introduced into the appearance of concrete masonry units, but without further treatment such masonry units will still be afflicted with a dull, rough surface appearance which may make them yet readily identifiable as only brighter versions of the old "cinder block."

In an effort to overcome this lingering association, and in order to produce finished masonry building materials of a consistent and precise size, concrete masonry units are subjected following curing to abrasion treatment in the form of grinding and cutting. This more attractively exposes the aggregate and the cement binder thereabout. Through the process of cutting and grinding, finished masonry building materials can be produced having a uniform, predetermined size and a variety of surface finish qualities. These finished masonry building materials are termed variously ground face, honed, or burnished masonry blocks.

Optionally, cement pastes or sealers can be applied to fill the pores in the surface and to preserve the freshness of the aggregate color and the binder patterns revealed by abrasion treatment. Heavier sealers produce a glossy surface on such finished masonry building materials. Occasionally cement paste is applied even prior to abrasion treatment.

It has also been found appropriate to use such cutting and grinding techniques in sizing and surface finishing of fired masonry blocks, such as bricks and paving stones. Accordingly, throughout the balance of this disclosure and the claims appended thereto, the term "masonry unit" will be used to mean an uncut, unpolished, unground concrete or fired masonry unit. Correspondingly, the product produced by cutting, grinding, or polishing masonry units as defined above will be referred to hereinafter as "finished masonry building materials". Thus, finished masonry building materials as used herein includes ground face, burnished, or honed concrete or fired masonry units in finished form.

For these reasons there is an upsurge of interest in the use of concrete masonry units in exposed walls in residential, retail, educational, governmental, and religious structures. Through the use of the techniques already mentioned, such humble building materials can be provided with a distinctive appearance or one elegant enough to be taken for terrazzo or cut stone. The edges of concrete masonry units can be ground into various shapes and the surfaces may be provided with attractive architectural relief. Naturally, the cost per square foot of producing such materials is quite competitive with the cost of quarrying, cutting, polishing, and setting natural stone itself. In fact, all that has been said above about improving the surface appearance of concrete masonry units also applies to those fired masonry units which may lack aggregates and are cured by baking in high temperature ovens. Therefore, a need has been perceived in the construction industry to develop sophisticated methods and apparatus using abrasion treatment to produce from inexpensive masonry units finished masonry building materials acceptable for an installation, even in the exposed portions of non-industrial structures.

The accident that masonry units when once cut and polished tend to resemble more expensive cut and polished natural stone has hampered the efforts to develop production equipment and methods specifically suited to the new man-made building materials. Instead, and inappropriately, the grinding and sawing techniques and equipment formerly utilized in natural stone quarrying and processing have been adopted wholesale in the finishing of masonry units. Techniques applicable to marble and terrazzo have been imported without careful consideration of their costliness or complexity into machinery designed to cut and polish fired masonry units and aggregates of cinder, gravel, and sand. The resulting devices were unduly heavy, extremely complex, and naturally expensive to acquire and maintain. This, in turn, added needlessly to the cost of the otherwise economical building materials produced from masonry blocks.

For example, due to the relatively high cost of producing from original stone even a single precision cut and polished piece, the equipment by which to finish natural stone did not employ continuous production line concepts that might have been appropriate with a less expensive product. Most cutting and polishing devices for natural stone treated the work pieces one at a time, using complex positioning and position sustaining equipment. When this approach was transferred directly into processing equipment for inexpensive masonry units, production output levels resulted that were substantially less than which should have been produced with relatively inexpensive products. Mass market economical construction materials were unfortunately being fabricated using approaches appropriate to individually crafted, artisan products.

By and large, because of historical roots which extended by accident into the natural stone processing industry, early equipment for the cutting and grinding of masonry units exhibited a tendency to over-kill. Massive equipment utilizing overly powerful drive mechanisms were more than adequate to the task at hand, but once in place as capital equipment these tended to needlessly drive up the cost of the finished masonry building materials being produced.

In other ways the components of such masonry block processing equipment exhibited an ironic inappropriateness. Natural stone being relatively hard and fine grained, was attacked in abrasive treatments by fine grained and fine toothed saws, sanding belts, and disk-shaped polishing pads at low speeds. When such components, ideally suited to processing natural stone, were unthinkingly incorporated into an environment for processing relatively soft and extremely coarse masonry building materials, the over-kill capacity elsewhere apparent in the processing equipment, resulted in dysfunction. Working heads appropriate to processing natural stone turned out to have quite short lifetimes when pitted against the softer, unpredictable compositions of concrete masonry units. Thus, working head failure was frequent, resulting in high maintenance costs and expensive downtime losses.

As the industry wrestled with the technology it had inherited, there became apparent a need to stand back and examine the process as a whole in order to arrive at a contemporary overall design that met the needs of the industry involved. Such an approach is embodied in the invention disclosed hereafter.

BRIEF SUMMARY AND OBJECTS OF THE INVENTION

One object of the present invention is to enhance the cost competitiveness of finished masonry building materials fabricated from concrete or fired masonry units.

Accordingly, an initial object of the present invention is the development of apparatus and methods for efficiently processing masonry block units into finished masonry building materials on a high volume basis.

It is thus an object of the present invention to provide an improved apparatus for producing finished masonry building materials from masonry units by subjecting the masonry units to abrasion treatment.

It is yet another object of the present invention to produce an apparatus of the type described which employs production line principles, and is therefore capable of producing construction materials at a rapid rate.

Generally, it is an object of the present invention to employ in this regard technology that is specifically suited to the size, volume, and material composition of masonry units, as opposed to natural stone.

Yet another object of the present invention is to produce an apparatus as described in which maintenance costs and downtime due to working head failure are minimized.

It is yet another object of the present invention to produce such an apparatus which is extremely flexible, in that it is capable of handling a wide variety of sizes of masonry units and treating such by a variety of abrasion methods, including sawing, grinding, and polishing.

It is another object of the present invention to afford a basic apparatus for finishing masonry units which is capable of being utilized with either air or water as a cooling and cuttings removal medium.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, an apparatus for finishing masonry units into finished masonry building materials is provided comprising a conveying means for supporting and transporting the masonry units along a conveyor path and a processing means located along that conveyor path for subjecting the masonry units to abrasion treatment as the masonry units are moved continuously, by the conveying means. The location of the processing means along the conveyor path defines a processing station. There, the abrasion treatment, which could include cutting, grinding, or polishing, produces from the masonry units on the conveying means finished masonry building materials of a predetermined size and surface finish quality. By means of this production line arrangement, the apparatus of the present invention is capable of processing a high volume of building materials in an efficient manner akin to the mass production techniques appropriate to a high volume, relatively inexpensive product.

The apparatus of the invention includes a number of specific subsystems that contribute individually to the effectiveness of the overall device. First, in one aspect of the invention, the processing means thereof comprises a rotatable working head for subjecting the masonry units to abrasion treatment in combination with a working head drive means, such as an electric motor, for rotating the working head. A work piece stabilization means is combined with the working head for restraining each masonry block on the conveying means as the masonry block is moved continuously past the rotatable working head and is subjected to abrasion treatment thereby.

The working head can take a number of forms. Optimally, in view of the production line layout of the present invention, these forms of the working head can be interchanged in a given apparatus using alternative processing tray assemblies as shown in the various drawings without any substantial need for retrofitting or alteration. In one embodiment, the working head comprises one or a plurality of cylindrical drums disposed above and normal to the conveyor path. Where a plurality of such drums are utilized, they are axially parallel and may individually be provided with a range of coarseness permitting a variation in the bite exercised by each.

A preferred form of the cylindrical drum contemplated comprises a hollow cylindrical core, an array of abrasive, such as natural or synthetic diamonds, mounted in a matrix on the exterior of the core, and a cap at each end of the cylindrical core for mounting the drum to an axle. It is through that axle that the cylindrical drum is driven in rotation by the working head drive means. Ideally, the rate of rotation of the working head drive means should be variable, either through varying the rate of rotation of the work head drive means or through altering the gear ratios between the drive means and the rotatable drum. In this manner, the speed of rotation of the working head can be optimally suited to the material of which the masonry units being processed are comprised.

The abrasive on the exterior of the core of the cylindrical drum can be deposited in a number of patterns. For example, a single track of abrasive can encircle the core at an acute angle to its axis, thereby resulting in a spiral configuration. This avoids the common pitfall of causing grooves to be deposited on the surface of the block being subjected to abrasion treatment. For faster abrasion treatment and longer working head lifetime, a plurality of tracks of abrasive can be disposed equally spaced about the circumference of the core encircling the core at an acute angle to its axis.

Alternatively, the work head of the present invention could take the form of a conventional saw blade disposed with the axis thereof normal to the conveyor path at the processing station. Often such saw blades include circumferentially deposited tracks of abrasive, such as natural or synthetic diamonds. A saw blade of this type can place cuts through masonry units being moved continuously past the processing station or can be used to trim the sides thereof. Opposed sides of the masonry block can be trimmed simultaneously through the use as a working head of a pair of parallel saw blades spaced apart a distance corresponding to a predetermined dimension of the finished masonry building materials. The pair of saw blades may be disposed coaxially on a shared rotatable axle, so that simultaneous abrasion treatment on opposite sides of each masonry block assists in maintaining the stability of the block on the conveying means.

The processing means envisioned in one embodiment of the present invention further comprises a processing tray supported above and parallel to the conveyor path at the processing station. The working head, in whatever form is appropriate, is rotatably mounted to the processing tray. By adjusting the height of processing tray above the conveyor path, it is possible to adjust the height of the finished masonry building materials resulting from the abrasion treatment of masonry units by the processing means. Accordingly, in one aspect of the present invention, height-adjustment means are provided for selectively varying the height of the working head above the conveyor path. One embodiment of such a height-adjustment means comprises a plurality of jacks upholding the processing tray over the conveyor path and a synchronizing means for effecting the simultaneous operation of all of those jacks.

In another aspect of the present invention, the work piece stabilization means functionally described above comprises structures directed to two distinct aspects of work piece stabilization. The first is a vertical work piece stabilization means for preventing vertical displacement of each of the masonry units; the second is a lateral work piece stabilization means for preventing lateral deviations of each of the masonry units. The vertical work piece stabilization means urges each of the masonry units downwardly against the chain when the masonry unit is subjected to abrasion treatment by the working head. The lateral work piece stabilization means on the other hand urges each of the masonry units into a fixed line of travel parallel to the conveyor path. The masonry units can, for example, be urged horizontally against a fixed part of the frame disposed parallel to the conveyor path. Either individually or in combination, these two structural aspects of work piece stabilization are considered to be within the scope of the inventive apparatus.

In one embodiment of the present invention, the lateral work piece stabilization means comprises a lateral stabilization rack disposed generally parallel to the conveyor path at the side of each of each of the masonry units when the masonry unit is subjected to abrasion treatment. A roller is mounted on the lateral stabilization rack with the axis thereof disposed vertically.

The surfaces of the vertical rollers facing the conveying path are designed to contact the sides of the masonry units being subjected to abrasion treatment and hold the masonry units in a stable orientation during that abrasion treatment. Toward this end, a horizontal attachment means is provided for securing the lateral stabilization rack to the frame and urging the roller mounted in the lateral stabilization rack against the side of each of the masonry units when the masonry unit is subjected to abrasion treatment.

In one example of such a horizontal attachment means, a support sleeve is rigidly secured to the frame, and a rod that is rigidly secured to the lateral stabilization rack is slidably disposed therethrough. Means disposed on the rod on the side of the support sleeve opposite from the lateral stabilization rack are provided for limiting the extent of movement of the rod and the lateral stabilization rack toward the conveyor path. A coil spring disposed in compression about the rod intermediate the support sleeve and the lateral stabilization rack urges the stabilization rack horizontally toward the conveyor path, so that the roller or rollers mounted in the lateral stabilization rack bear against the sides of passing masonry units. A pair of such lateral stabilization racks can be disposed on opposite sides of the conveyor path with either one or both being spring biased horizontally toward the conveyor path.

Thus, when a masonry block on the conveying means enters the processing station, it is resiliently clamped at the size thereof by vertical rollers mounted in the lateral stabilization rack. The vertical rollers permit the masonry block to continue to move through the processing station, encountering the working head in a modern, assembly-line type arrangement. An appropriate configuration of the lateral stabilization rack in combination with a horizontal attachment means functioning as above yields a very desirable result in that masonry units being moved past the working head are sustained in a fixed horizontal relationship which permits consistent, precise, sizing of the resultant finished masonry building materials.

In one embodiment of the present invention, the vertical work piece stabilization means comprises a vertical stabilization rack disposed generally parallel to the processing tray with one or more horizontal rollers rotatably mounted on the stabilization rack above and normal to the conveyor path. The surfaces of the rollers opposing the conveyor path are designed to contact the top surface of the masonry units being subjected to abrasion treatment and hold the masonry units in a stable orientation during that treatment. Toward this end, vertical attachment means are provided for securing the vertical stabilization rack to the processing tray and urging the horizontal rollers to bear against the top of the masonry units moving past the processing station on the conveyor means.

At the same time, the working head, in whatever form is appropriate, will engage the masonry block and subject it to abrasion treatment. Thus, the surface of the horizontal rollers opposing the conveyor path must be disposed at a height relative to the working head which permits, both working head engagement with the masonry block, and the bearing of the roller thereagainst simultaneously. In the case of the drum-type cylindrical working head, this is a more critical spatial relationship than with a working head embodiment in the form of a saw blade.

In one embodiment of such a vertical attachment means, spring-tensioning mounts are placed between the vertical stabilization rack and the processing tray. Each mount typically comprises a first mounting eye formed through the vertical stabilization rack and a second mounting eye formed through the processing tray at a location opposite the first mounting eye. A threaded bolt is disposed through the first and second mounting eyes and a nut is threaded onto the end of the bolt opposite from its head. Somewhere between the head of the bolt and the nut a coil spring is disposed in compression. In one embodiment, where the vertical stabilization rack is disposed on the side of the processing tray opposite from the conveyor path, this coil spring is disposed between the nut and the processing tray.

Nevertheless, an appropriate configuration of the vertical stabilization rack and processing tray in combination with a vertical attachment means functioning as above yields a very desirable result in that masonry units being moved past the working head are sustained in a fixed relationship which permits consistent, precise, sizing of the resultant finished masonry building materials. Thus, when a masonry block on the conveying means enters the processing station, it is resiliently clamped at the top thereof by horizontal rollers mounted in the vertical stabilization rack. The horizontal rollers permit the masonry block to continue to move through the processing station, encountering the working head, in a modern, assembly-line type arrangement.

The process of abrasion treatment creates a great deal of heat, dust, and cuttings. A hood is frequently disposed over the conveyor path at the processing station to confine the cuttings and dust. In combination therewith, in another aspect of the present invention, extraction means are provided for removing cuttings and heat from the processing station. One embodiment, such an extraction means comprises piping for delivering a fluid under pressure into the hood and nozzles for directing the fluid in the piping onto the masonry units after their abrasion treatment or onto the working head to effect cleaning and cooling. In the latter case, the hood may be additionally provided with a vacuum-evacuation system for removing dust particles from the immediate vicinity of the working head.

As used herein in connection with the extraction means of the present invention, the term "fluid" includes any and all liquids or gases suitable for cleaning or cooling purposes. Thus, the fluid involved may be water or even a liquified gas.

In one embodiment of the invention, a conveying means capable of performing the function described above comprises a frame, and one or more chains movably supported from the frame along the conveyor path. Each of the chains are comprised of a plurality of links connected in sequence to form an endless loop. A chain drive means is employed for advancing the chain or chains together in order to transport the masonry units from the input station at which they are initially placed in the conveyor path to an output station at which the masonry units have been converted into construction materials. A plural sequence of support plates are secured individually to the links of a single chain or secured to and supported between the links of each of two chains, if such are employed in the device. The support plates uphold the masonry units during transport along the conveyor path.

At the processing station, the frame comprises an immovable bearing surface for supporting the masonry units during abrasion treatment. In one embodiment of the inventive apparatus, such an immovable bearing surface comprises a rail supporting individual links of the chain used to transport the blocks and a rigidifying brace for the rail to substantially eliminate any flexibility therein. With this arrangement, each masonry block is securely clamped to a non-yielding surface by the work piece stabilization means of the device during abrasion treatment at the processing station.

Lateral movement of the masonry units on the conveyor path remote from the processing station is circumscribed by a pair of guide rails located on opposite sides of the conveyor path. The separation between such guide rails is selectively adjustable to accommodate for masonry units of different sizes.

The present invention also includes a corresponding method for finishing masonry units into finished masonry building materials. That method comprises the steps of loading masonry units at an input station onto a conveyor chain supported along a conveyor path from the input station to an output station for finished masonry building materials. Thereafter the chain is advanced to transport the masonry units along the conveyor path. Lateral movement of the masonry units from the conveyor path during this transport is circumscribed.

At a processing station located along the conveyor path between the input and output stations, the inventive method includes the step of restraining the masonry units against the chain and rotating a working head located at the processing station capable of subjecting the masonry units to abrasion treatment. Optionally, the masonry units are horizontally restrained during the process. The masonry units are moved continuously past the processing station subjecting the masonry units to the abrasion treatment and producing therefrom finished masonry building materials of a predetermined size and surface finish quality.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Figure 1:
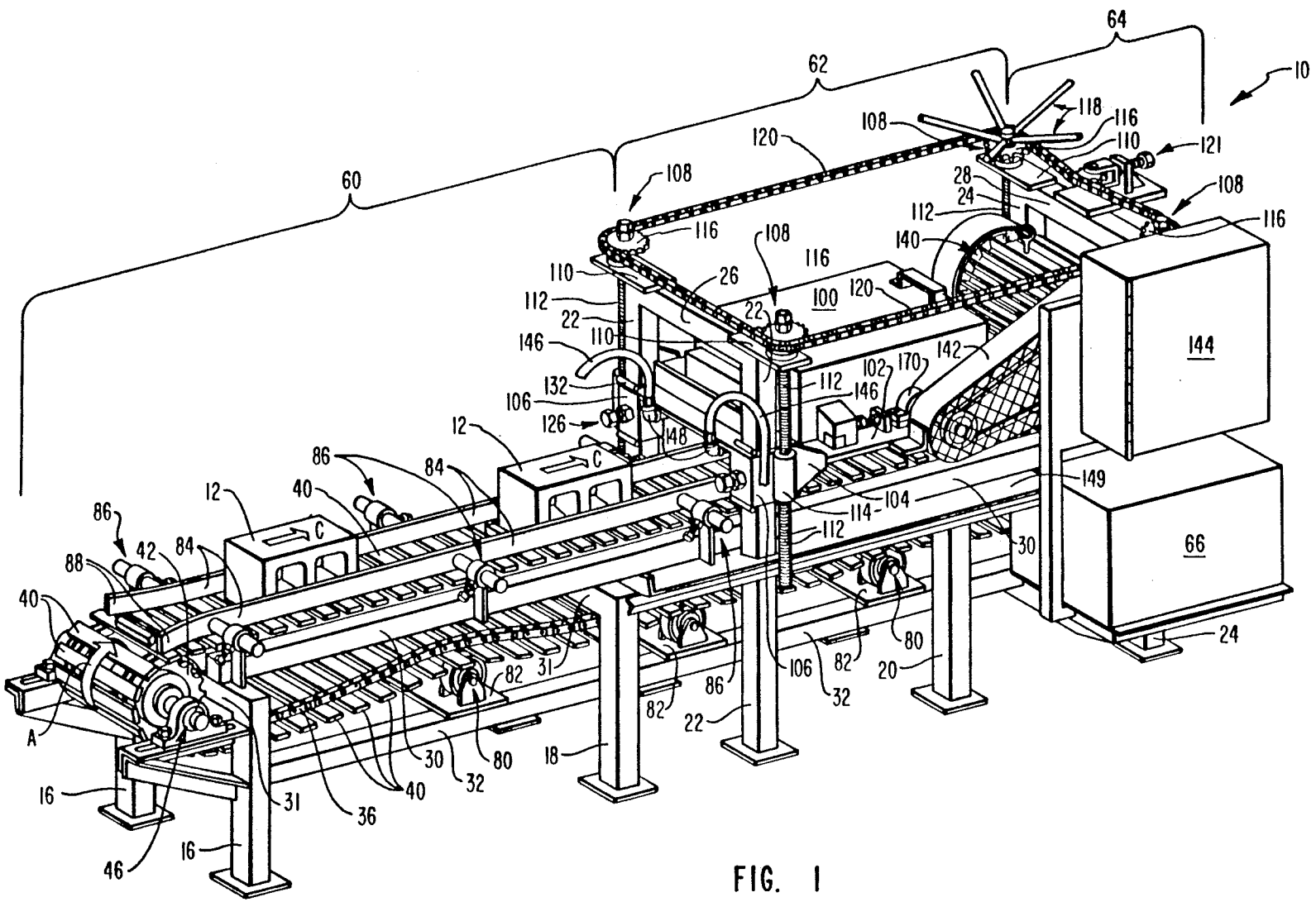
FIG. 1 is a perspective view of one embodiment of an apparatus for finishing masonry units according to the teachings of the present invention.
Figure 2:
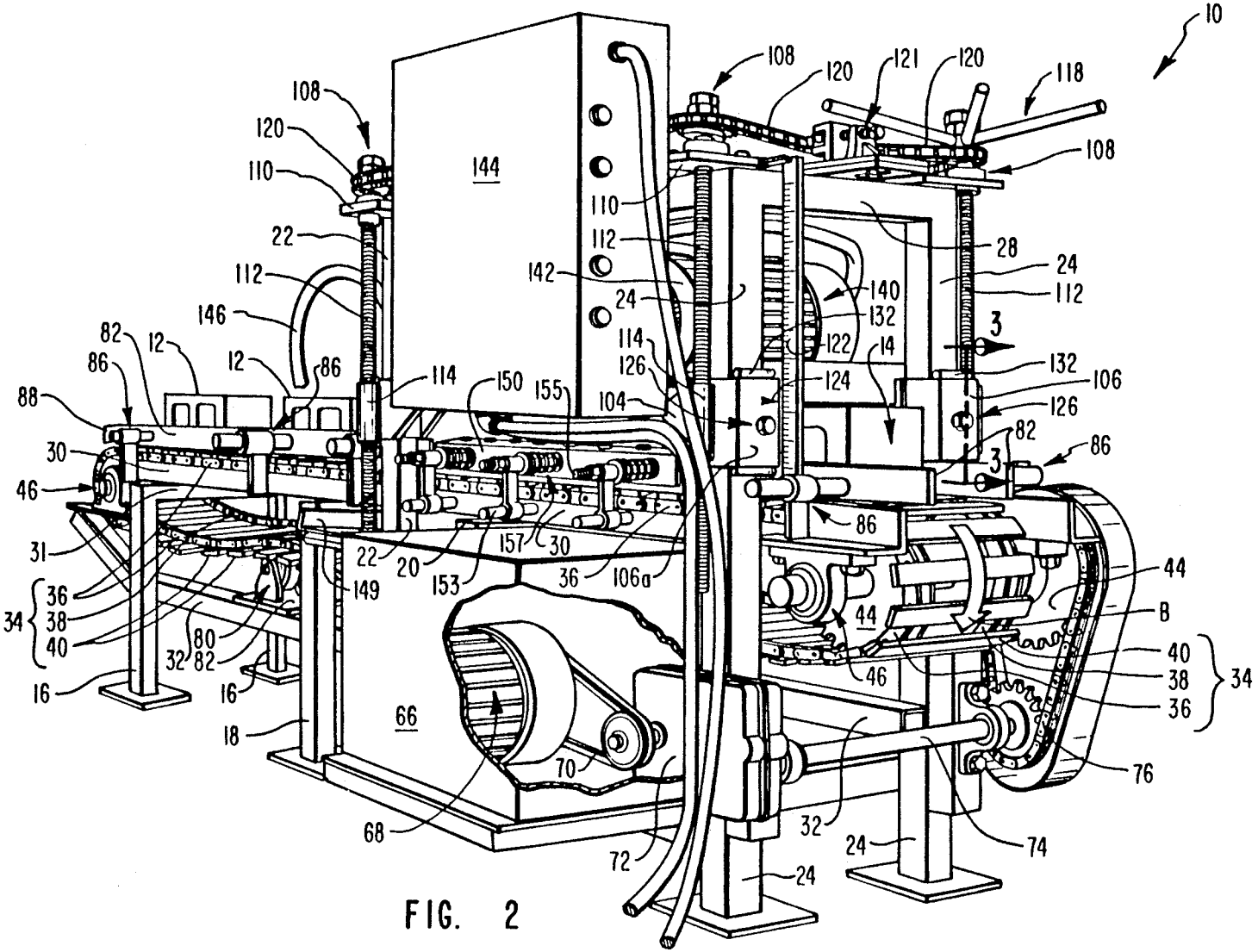
FIG. 2 is a second perspective view of the apparatus shown in FIG. 1 taken from an alternate vantage.

The apparatus and method of the present invention are best appreciated by initially viewing FIGS. 1 and 2 together. There shown is one embodiment of an apparatus 10 configured in production line fashion for finishing masonry units 12 into finished masonry building materials 14 (FIG. 2). The various subsystems of apparatus 10 are mounted to a frame comprising relatively short vertical supports 16, 18, 20 which rise to the level of the conveyor path, and taller vertical supports 22, 24 which extend above the conveyor path where they are interconnected over the top thereof by horizontal braces 26, 28, respectively. Parallel with the conveyor path short vertical supports 16, 18, 20 and tall vertical supports 22, 24 are interconnected parallel to the conveyor path at the level thereof by upper beams 30 and therebelow by lower beams 32. Upper beams 30 are supported on lower horizontal braces 31 interconnecting the pairs of short vertical supports 16, 18, 20 on opposite sides of the conveyor path of apparatus 10. As shown in FIG. 1, lower beams 32 are, however, directly attached to short vertical supports 16, 18, 20 and taller vertical supports 22, 24. Other components of the frame of apparatus 10 will be described as the need arises.

Movably supported from the frame of apparatus 10 is a conveyor belt 34 comprised of a first and a second chain 36, 38 and a plurality of support plates 40 secured therebetween. First and second chains 36, 38 individually comprise a plurality of links connected in sequence to form an endless loop. It is by attachment to individual of such links that support plates 40 are made an integral part of conveyor belt 34. Conveyor 34 passes over a pair sprocketed wheels 42, 44 mounted in bushings 46 at opposite ends of the frame of apparatus 10. This permits sprocketed wheels 42, 44 to rotate and thereby enable the upper length of conveyor 34 to move along the conveyor path of apparatus 10, while the lower length of conveyor 34 returns in the opposite direction beneath the conveyor path. The direction of motion of conveyor 34 is shown at sprocketed wheel 42 by Arrow A and at sprocketed wheel 44 by Arrow B. (FIG. 2)

Accordingly, masonry units 12 which are upheld on the upper length of conveyor belt 34 by support plates 40, move along the conveyor path of apparatus 10 in the direction shown by Arrow C. In doing so, masonry units 12 move from an input station 60 where masonry units 12 are loaded onto conveyor belt 34, through a processing station 62 where masonry units 12 are subjected to abrasion treatment, and on to an output station 64 where masonry units 12 assume the form of finished masonry building materials 14. In apparatus 10 a chain drive means is provided for advancing first and second chains 36, 38 of conveyor belt 34 in the direction shown by Arrows A and B. As shown by way of example in FIG. 2, enclosed in a housing 66 located at output station 64 is a conveyor belt drive motor 68 which by way of drive belt 70, gear reduction box 72, sprocketed drive axle 74, and drive chain 76 is operably interconnected with one of sprocketed wheels 44.

Alternatively, where desired conveyor belt drive motor 68 could be replaced by a gasoline engine. When operated, Conveyor belt drive motor 68 rotates the mechanisms interconnecting it with drive chain 76 which in turn rotates sprocketed wheels 44 to advance first and second chains 36, 38 which are suspended rotationally at the opposite end thereof over free rotating sprocketed wheels 42. The lower portion of conveyor belt 34 below the conveyor path of apparatus 10 is supported at a number of locations on pairs of support rollers 80 mounted on lower lateral braces 82 extending between lower beams 32.

The movement of each masonry block 12 along the conveyor path of apparatus 10 is constrained in a number of manners. First, lateral deviation of masonry units 12 from their intended course or orientation is circumscribed by a pair of guide rails 84 on either side of the conveyor path slightly above the surface of support plates 40. The separation between guide rails 84 precisely accommodates the lateral width of the type of masonry unit 12 being supported and transported along the conveyor path of apparatus 10. This separation is rendered adjustable by the mounting of guide rails 84 in slidable fittings 86 are located along the length of guide-rail 84 on the outside of the conveyor path of apparatus 10 and are provided with a set screw or other types of securement mechanisms. By loosening such securement fittings and sliding guide rails 84 laterally, the appropriate separation therebetween can be achieved with which to process and finish any desired size of masonry unit. The ends of guide rails 84 at input station 60 are flared outwardly in the form of receiving arms 88, which assist in the loading of masonry units 12 onto conveyor belt 34 at input station 60.

To further insure that masonry units 12 advance along the conveyor path of apparatus 10, selected non-adjacent support plates 40 are provided with upstanding pusher stops 90. In passing through processing station 62, the abrasion treatment applied to masonry units 12 has a tendency to retard the free forward movement thereof in the desired direction indicated by Arrow C. It is the function of pusher stops 90 to abut each masonry unit 12 as it enters the abrasion treatment in processing station 62 and preclude rearward movement of masonry units 12 relative to the motion of conveyor belt 34. Thus, in processing station 62 pusher stops 90 in combination with the movement of conveyor belt 34 provide to masonry units 12 the needed forward impetus to overcome the resistance thereto presented by the abrasion treatment to which masonry units 12 are subjected.

In one embodiment of an apparatus according to the present invention as shown in FIGS. 1 and 2, a hood 100 is disposed over the conveyor path of apparatus 10 and processing station 62 for confining dust and cuttings produced by the abrasion treatment applied to masonry units 12. As will be discussed in more detail in relation to subsequent figures, beneath hood 100 may be disposed any of a number of embodiments of a working head by which the masonry units 12 are subjected to that abrasion treatment. The working head is rotatably mounted on a processing tray 102 supported from the frame of apparatus 10 and more specifically from taller vertical supports 22, 24 thereof, above and parallel to the conveyor path of apparatus 10. Processing tray 102 is positioned above the conveyor path of apparatus 10 at a predetermined distance which permits the working head mounted on processing tray 102 to produce from masonry units 12 finished masonry building materials 14 having a predetermined vertical dimension. Nevertheless, it is a feature of the present invention that the distance of processing tray 102, and thus of the working head of apparatus 10, above the conveyor path thereof is adjustable in order to enable apparatus 10 to readily accommodate for the production of finished masonry building materials 14 of various sizes.

Thus, according to the present invention, the processing means thereof includes a height-adjustment means for selectively varying the height of the working head of an apparatus, such as apparatus 10, above the support plates 40 or any other upper surface of a conveyor belt, such as conveyor belt 34. As shown in FIGS. 1 and 2 by way of example and not limitation, processing tray 102 is slidably supported on taller vertical supports 22, 24 by triangular attachment plate 104 secured to a rectangular sleeve 106 which slidably fits on the exterior of taller vertical supports 22, 24. To each rectangular sleeve 106 corresponds a jack 108 rotatably mounted through a jack plate 110 at the top of tall vertical supports 22, 24. Each jack 108 comprises a threaded shaft 112 which is threadably received in a sleeve 114 on the exterior of each rectangular sleeve 106. In this manner the plurality of jacks 108 uphold processing tray 102 over the conveyor path of apparatus 10.

The upper end of each threaded shaft 112 is provided with a means for rotating that corresponding threaded shaft. As shown in FIGS. 1 and 2, by way of example, such a means for rotating threaded shafts 112 can include a sprocket 116 or a handle 118 coaxially attached at the top end of threaded shaft 112. Rotation of threaded shaft 112 of jack 108 using either sprockets 116 or handle 118 will thus raise or lower on the corresponding taller vertical supports 22, 24 the sliding rectangular sleeve 106 from which processing tray 102 is supported. This serves to vary the distance of processing tray 102 and the working head mounted thereon from the conveyor path of apparatus 10.

Nevertheless, it is important to the production of finished masonry building materials 14 having level upper surfaces that any raising or lowering of processing tray 102 be accomplished so that processing tray 102 remains horizontal, generally parallel to support plates 40 of conveyor belt 34. Accordingly, toward this end the height adjustment means of the present invention further comprises a synchronizing means for effecting the simultaneous operation of the plurality of jacks 108. As shown by way of example and not limitation in FIGS. 1 and 2, a height adjustment chain 120 comprising a plurality of links connected in sequence to form an endless loop encircles the top of processing station 62 engaging each of sprockets 116. This arrangement ensures that the rotation of any one sprocket 116 of a jack 108 is reflected in an equal and corresponding rotation of all other sprockets 116 in the plurality of jacks 108.

In order to easily effect such rotation, at least one of the jacks 108 is provided with an operating handle, such as handle 118. Thus, rotation of handle 118 will serve to operate all of the plurality of jacks 108 and raise or lower processing tray 102 in an articulated manner. To provide suitable tension in height-adjustment chain 120, a chain tensioning adjuster 121 is secured on horizontal brace 28. To assist the operator of handle 118 in setting the height of processing tray 102 as desired, a height gauge 122 is secured to horizontal brace 28 at output section 64 of apparatus 10 (FIG. 2). In cooperation therewith a height indicator 124 is affixed to an adjacent surface of rectangular sleeve 106 which is slidable with processing tray 102 relative to the fixed support of height gauge 122 on horizontal brace 28.

Once processing tray 102 has been moved to a desired height by operation of the plurality of jacks 108, it is necessary to fix that height so that the repeated subjection of masonry units 12 to abrasion treatment does not displace processing tray 102. Accordingly, the height-adjustment means of the present invention further comprises a clamp to preclude movement of height adjustment chain 120 when the separation of processing tray 102 above the conveyor path of apparatus 10 is to remain fixed. While a number of structural arrangements could provide for this function, as shown by way of example in FIGS. 1 and 2 and certainly not by way of limitation, a clamp 126 is provided corresponding to each of the plurality of jacks 108.

Figure 3:
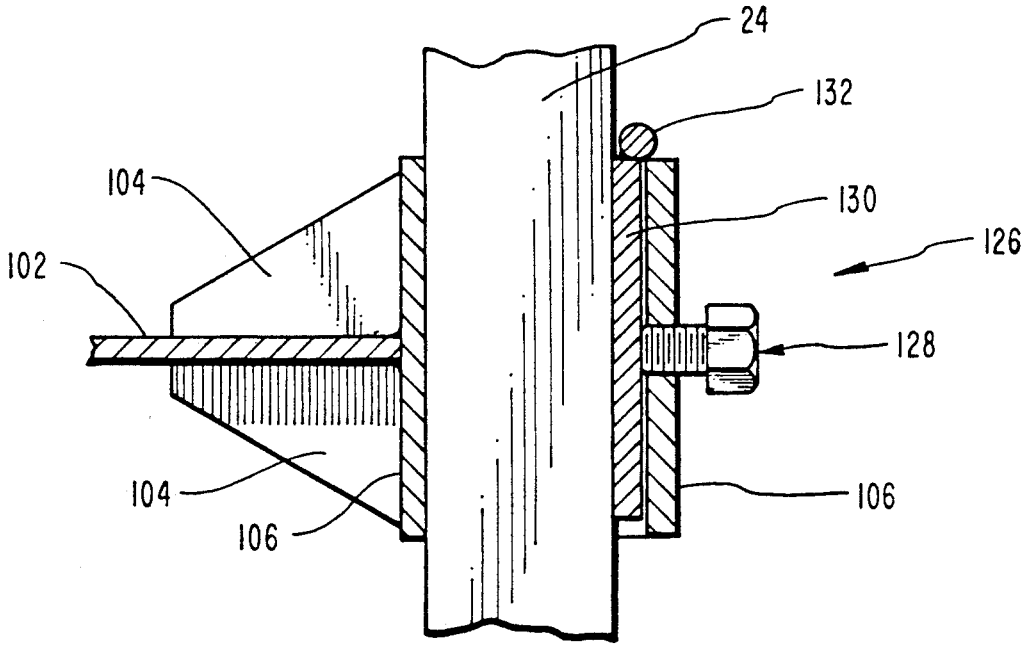
FIG. 3 is a cross-sectional elevation view taken along section line 3—3 in FIG. 2 of a clamp used to fix the separation of the working head of the apparatus shown from the conveyor path upon work pieces are supported.

As shown in additional cross-sectional detail in FIG. 3, clamp 126 comprises a clamping bolt 128 threaded through one wall of rectangular sleeve 106 and a pressure plate 130 disposed inside rectangular sleeve 106 between the lead end of clamping bolt 128 and taller vertical support 24. When clamping bolt 128 is threaded inwardly it impinges pressure plate 130 and through that structure applies to tall vertical support 24 a broadly disposed clamping pressure between pressure plate 130 and the wall of rectangular sleeve 106 on the opposite side of tall vertical support 24 therefrom. Pressure plate 130, therefore, prevents damage to the face of tall vertical support 24 which might result were clamping bolt 128 to apply a locally focused clamping pressure directly thereto. In order to retain pressure plate 130 in the desired position thereof, and to preclude pressure plate 130 from falling downwardly out of rectangular sleeve 106 when the pressure of clamping bolt 128 is released, a retention bar 132 which will not pass through rectangular sleeve 106 is welded to the upper edge of pressure plate 130.

Before leaving the overview provided by FIGS. 1 and 2, it should be noted that apparatus 10 includes a working head drive means shown, by way of example and not limitation, as a drive head motor 140 that is operably interconnected by belts or other mechanisms safely secured in belt housing 142 to the working head within hood 100. Power for working head drive motor 140 and for conveyor belt dive motor 68 is directed through electrical controls and safety fuses housed in an electrical control box 144 mounted above housing 66 in output section 64 of apparatus 10.

In addition, flexible hoses 146 connected to fluid piping 148 deliver fluid under pressure into hood 100 for removing or controlling heat, cuttings, and dust at processing station 62. Thus, the fluid employed can serve either or both as a coolant or as a cleansing medium. According to the type of processing desired for masonry units 12, the fluid may be either a liquid or a gas under pressure. Where the fluid is a liquid, a collecting tray 149 is provided below the upper portion of conveyor belt 34 to capture such fluid and the cuttings and dust and trained therein.

Turning now to the remaining figures of this application, a variety of embodiments of rotatable working heads suitable for use with apparatus 10 and structures associated therewith, but obscured in FIGS. 1 and 2 by hood 100, will be explored in detail. Nevertheless, wherever possible structural elements previously identified in FIGS. 1 and 2 will continue in FIGS. 4–7 to be identified by identical reference characters. Where a given structure in FIGS. 4–7 varies somewhat among the embodiments there discussed, related reference characters will be used. For example, the processing trays shown in each of FIGS. 5–7 exhibit minor structural, although not functional variations. Accordingly, rather than referring to such processing trays by reference character 102, which is used in FIGS. 1 and 2, the reference characters 102*a*, 102*b*, 102*c* will be used in FIGS. 5, 6, and 7, respectively, to refer to the processing tray.

Figure 4:
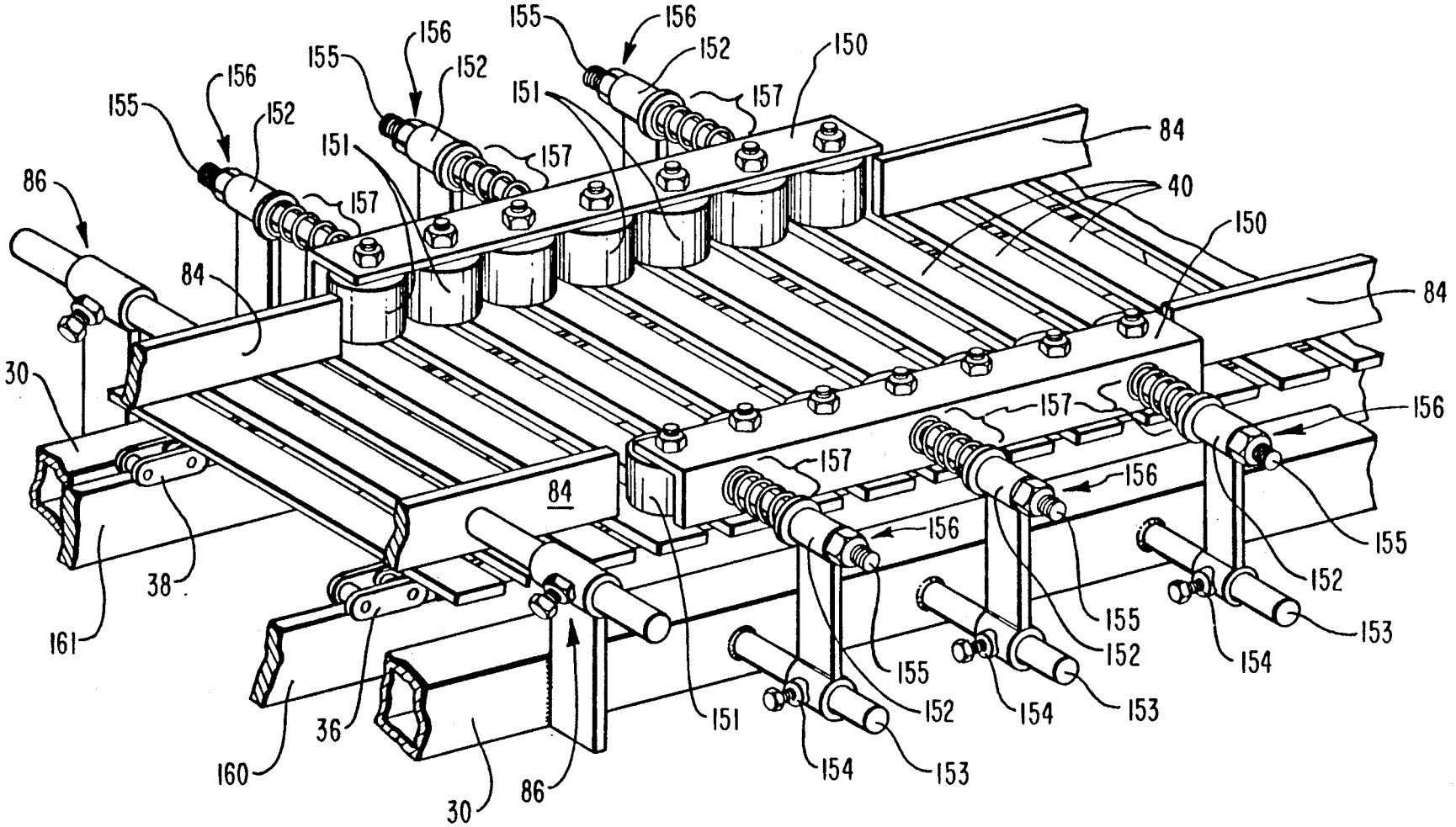
FIG. 4 is a perspective view of the conveyor path of the apparatus of FIG. 1 at the processing station thereof.
Figure 5:
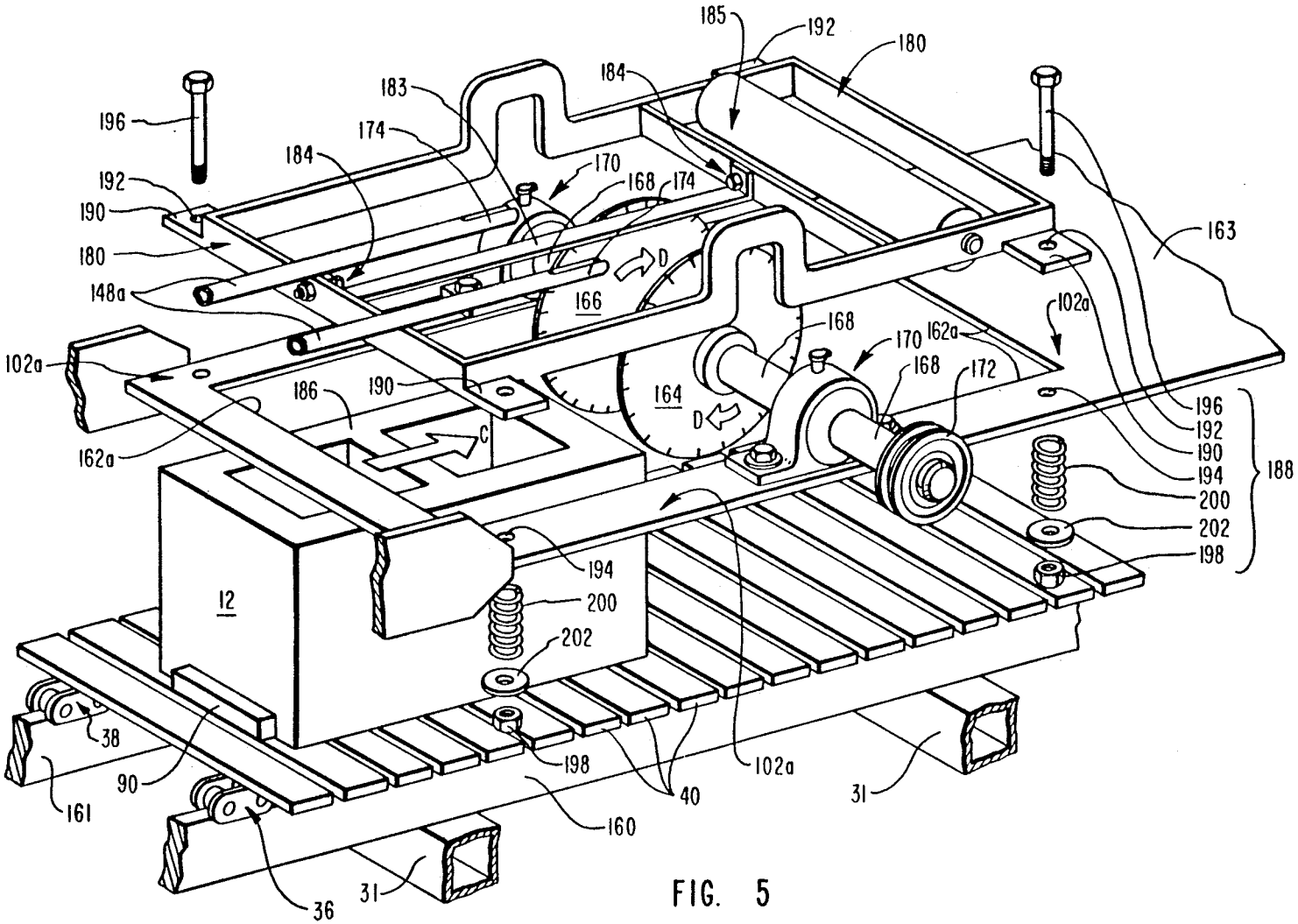
FIG. 5 is an exploded perspective view of one embodiment of a working head and components associated immediately therewith for the apparatus of FIG. 1.
Figure 6:
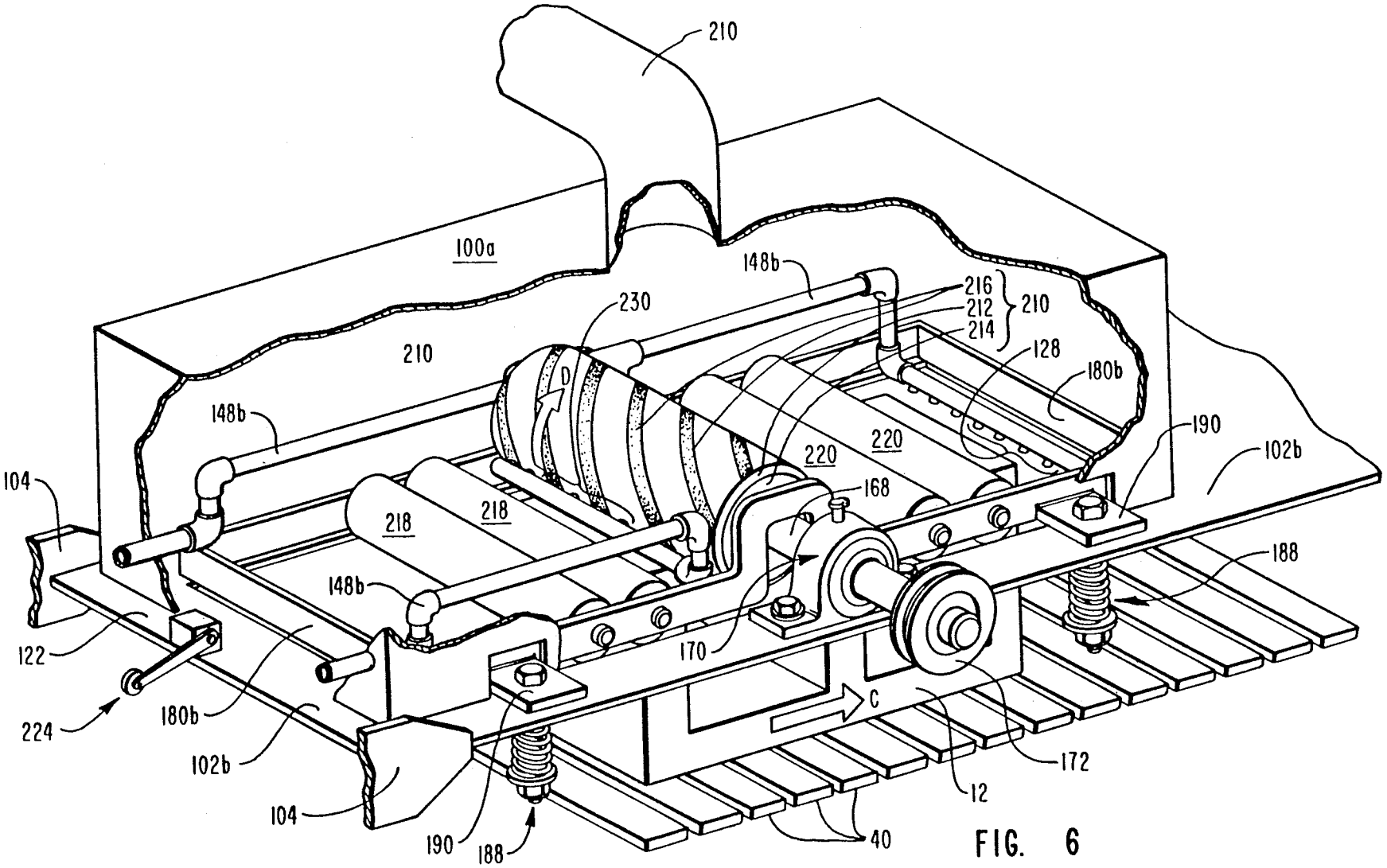
FIG. 6 is a perspective view of a second embodiment of a working head and components associated immediately therewith for use in the apparatus shown in FIG. 1.
Figure 7:
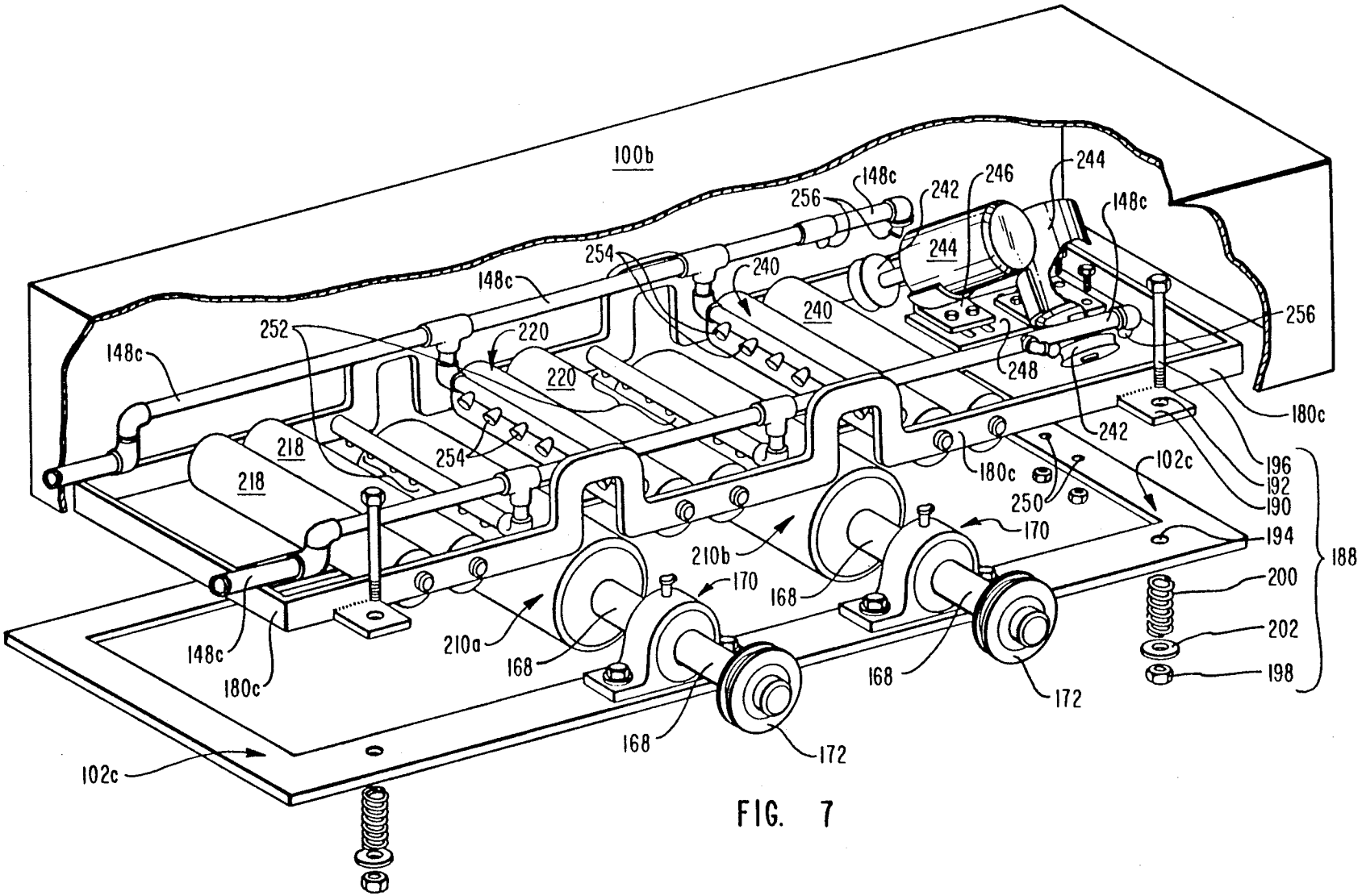
FIG. 7 is an exploded perspective view of a third embodiment of a working head and components associated immediately therewith for use in the apparatus shown in FIG. 1.

FIG. 4 illustrates structures employed in apparatus 10 at processing station 62 thereof to provide one aspect of stability to masonry units 12 during abrasion treatment thereof. The present invention includes a work piece stabilization means for restraining each masonry unit on the conveyor chain of the apparatus as the masonry unit is moved continuously past the working head of the unit and is subjected to abrasion treatment thereby. Such a work piece stabilization means can in the present invention take on either or both of two stabilization aspects. A vertical work piece stabilization means can be provided for preventing vertical displacement of each of the masonry units when the masonry unit is subjected to abrasion treatment. In lieu of, or in addition thereto, the work piece stabilization means may comprise a lateral work piece stabilization means for preventing lateral deviation of each of the masonry units when the masonry unit is subjected to abrasion treatment. Such a lateral work piece stabilization means can in one embodiment of the present invention urge each of the masonry units moving continuously past the processing station into a fixed line of travel parallel to the conveyor path. Alternatively the lateral work piece stabilization means can urge each of the masonry units against a fixed part of the frame of apparatus 10 that is disposed parallel to the conveyor path. FIG. 4 illustrates one typical embodiment of such a lateral work piece stabilization means, while embodiments of a vertical work piece stabilization means are shown in FIGS. 5–7.

In FIG. 4 a lateral stabilization rack 150 is provided on either side of the conveyor path of apparatus 10 generally parallel thereto at the side of the masonry units (not shown) that are moving continuously past processing station 62 of apparatus 10. A plurality of vertical rollers 151 are rotatably mounted on lateral stabilization rack 150 with the axes thereof disposed normal to the conveyor path of apparatus 10. In one aspect of the present invention, horizontal attachment means are provided for securing lateral stabilization rack 150 to upper beam 30 of the frame of apparatus 10. The horizontal attachment means in addition urges vertical rollers 151 against the sides of any masonry units moving past the processing station of apparatus 10 and being subjected to abrasion treatment.

As shown in FIG. 4, such a horizontal attachment means can comprise a support sleeve 152 secured to upper beam 30 on a support post 153. As the size of the masonry units to be processed by apparatus 10 will vary in the lateral direction, various forms of lateral adjustability are provided in the horizontal attachment means of apparatus 10. Thus, if desired, each support sleeve 152 may be structured to be slidable and selectively securable on support posts 153 in the same manner as are slidable fittings 86. In FIG. 4 adjustment fittings 154 serve this purpose.

A plurality of rods 155 are rigidly secured to the outside of lateral stabilization racks 150 and are slidably disposed through support sleeves 152 as shown. Means are then disposed on each rod 155, on the side of support sleeve 152 opposite from lateral stabilization rack 150, for limiting the extent of movement of rods 155 and lateral stabilization racks 150 toward the conveyor path of apparatus 10. In FIG. 4, such a means takes the form of a thread-and-nut combination 156 on the free end of rods 155. The nut of thread-and-nut combination 156 is larger than the inside diameter of support sleeve 152 and cannot pass therethrough. Accordingly, rotation of the nut of thread and nut combination 156 along rod 155 toward lateral stabilization rack 150 will reduce the extent by which lateral stabilization rack 150 can move toward the conveyor path of apparatus 10.

A coil spring 157 is disposed in compression about each rod 155 intermediate support sleeve 152 and lateral stabilization rack 150. Coil springs 157 urge lateral stabilization racks 150 horizontally toward the conveyor path of apparatus 10 to the extent permitted by thread-and-nut combinations 156. Accordingly, when masonry units pass through the processing station of apparatus 10, the surfaces of vertical rollers 151 are urged against the sides of the masonry blocks, sustaining the fixed line of travel thereof parallel to the conveyor path.

Vertical rollers 151 may be structured in a variety of manners consistent with the objectives of present invention. It is presently preferred, however, that vertical rollers 151 be relatively small in diameter, so as to be mountable in lateral stabilization rack 150 in close proximity one to another. In this way, a plurality of vertical rollers 151 will engage the sides of any one masonry unit 12 passing along the conveyor path of apparatus 10, thereby insuring enhanced stability therein. Although vertical rollers 151 could be fabricated of a number of materials, hard rubber has been found to be optimally effective in affording purchase on the sides of masonry units moving along conveyor belt 34 without causing damage thereto.

Shown in FIG. 5 is one embodiment of a working head and immediately associated structures suitable for use with apparatus 10 under the enclosure of hood 100 at processing station 62. A masonry unit 12 is shown upheld on support plates 40 of a conveyor belt 32 comprised of first chain 36 and second chain 38. Masonry unit 12 in FIG. 5 is moving along the conveyor path of apparatus 10 in the direction shown by Arrow C. A pusher stop 90 has come to engage the rear wall thereof. For the purpose of clarity, guide rails 84 and lateral stabilization rack 150 have been eliminated from either side of masonry unit 12. Masonry unit 12 is about to be subjected to abrasion treatment in order to produce therefrom finished masonry building material.

According to one aspect of the present invention, the frame of apparatus 10 in the vicinity of processing station 62 has been configured to comprise an immovable bearing surface for supporting masonry unit 12 as abrasion treatment is applied thereto. As shown in FIG. 4 by way of example and not limitation, a first rail 160 supports the individual links of first chain 36, while a second rail 161 supports the individual links of second chain 38. Supporting both first and second rails 160, 161 are lower horizontal braces 31 disposed transverse thereto. At this point in the frame of apparatus 10, lower horizontal braces 31 function as rigidifying braces for first and second rails 260, 161 to substantially eliminate vertical flexibility therein.

A processing tray 102*a* with triangular attachment plates 104 at the corners thereof adjacent to input station 60 of apparatus 10 can be seen supported above and parallel to the conveyor path of apparatus 10 at a predetermined distance from support plates 40. Processing tray 102*a* includes at the end thereof adjacent to input station 60 of apparatus 10 an opening 162 and at the opposite end thereof a solid skirt 163 upon which to mount working head drive motor 140 shown in FIGS. 1 and 2.

The working head in FIG. 5 takes the form of a pair of parallel saw blades 164, 166 coaxially disposed on an axle 168 and rotatably mounted on processing tray 102*a* by bushings 170, so as to partially depend through opening 162 into the line of travel of any masonry unit 12 passing by processing station 62 of apparatus 10. One end of axle 168 on the opposite side of bushing 170 from saw blades 164, 166 is provided with a drive wheel 172 operably interconnected with working head drive motor 140 through the structure contained in belt housing 142 to rotate saw blades 164, 166. Saw blades 164, 166 are spaced apart a distance that corresponds to a predetermined dimension of the finished masonry building material that is desired to be produced from masonry unit 12. The axes of saw blades 164, 166 are parallel to support plates 40 and normal to the conveyor path along which masonry unit 12 is being transported.

As masonry unit 12 moves continually past the processing station in which saw blades 164, 166 are disposed, the rotation of saw blades 164, 166 subjects masonry unit 12 to abrasion treatment. Saw blades 164, 166, could, for example, shave the edges off masonry unit 12 or inscribe therein a pair of parallel slots. Nevertheless, regardless of the form in which masonry unit 12 emerges from the abrasion treatment afforded by saw blades 164, 166, that abrasion treatment generates substantial heat, particularly in saw blades 164, 166, and substantial dust and cuttings.

To control these two problems, an extraction means is provided for removing cuttings and heat from the processing station of an apparatus, such as apparatus 10. In the case of saw blades 164, 166, shown in FIG. 5, this extraction means also cools the saw blades themselves. A set of piping 148*a* delivers a fluid under pressure into the proximity of the abrasion treatment. Nozzles 174 at the open ends of piping 148 direct the fluid in piping 148 onto the cutting edges of saw blades 164, 166. The fluid involved can either be a liquid or a gas under pressure, but in either case these materials serve both to cool the cutting edges of saw blades 164, 166 and to remove from the vicinity thereof cuttings and dust being generated by the abrasion treatment of masonry unit 12. Nozzles 174 consist of a lateral slot in the open end of piping 148*a* that receives the edge of saw blades 164, 166 when the components shown in 164 are assembled together. This structure in nozzle 174 retains the cooling and flushing fluid in piping 148*a* in the vicinity of the cutting edges of saw blades 164, 166.

In another aspect of the present invention, the processing station of an apparatus, such as apparatus 10, is provided with a work piece stabilization means for restraining each masonry unit on the conveyor chain of the apparatus as the masonry unit is moved continuously past the working head of the unit and is subjected to abrasion treatment thereby. As explained previously, one aspect of the work piece stabilization means of the present invention comprises a vertical work piece stabilization means for preventing vertical displacement of each of the masonry units being subjected to abrasion treatment. The vertical work piece stabilization means urges the masonry, units moving past the processing station downwardly against conveyor belt 34 during abrasion treatment.

As shown in FIG. 5 by way of example and not limitation, a stabilization rack 180*a* is disposed generally parallel to processing tray 102*a*. A restraining strap 183 is supported from processing tray 102*a* parallel to the conveyor path of apparatus of 10 in close proximity to the top of any masonry unit 12 moving past processing station 62. When assembled, restraining strap 183 passes between axle 168 and any masonry unit 12 on conveyor belt 34. Toward this end, restraining strap 183 is removably secured to stabilization rack 180*a* by nut-and-bolt fittings 184. Saw blades 164, 166 will generally rotate in the direction indicated by Arrow D, causing the lead edge of any masonry unit 12, to be lifted upwardly off of conveyor belt 34. It is the function of restraining strap 183 to curtail this upward movement of the lead edge of any masonry unit 12. Restraining strap 183 is not, however, generally urged against the top surface of masonry units 12, as is another component of the vertical work piece stabilization means of apparatus 10.

As shown by way of example and not limitation in FIG. 5, rotatably mounted on stabilization rack 180 is a horizontal roller 185 that is normal to the conveyor path along which masonry unit 12 is being transported. It is the purpose of horizontal roller 185 against the upper surface 186 of masonry unit 12 as masonry unit 12 is being subjected to abrasion treatment by saw blades 164, 166. As with vertical rollers 151 in FIG. 4, horizontal roller 185 is preferably of a small diameter and made of hard rubber. During initial abrasion treatment by saw blades 164, 166 restraining strap 183 will substantially maintain the vertical stability of masonry unit 12 on support plates 40.

The movement of conveyor belt 34 of apparatus 10 will continuously draw masonry units 12 past the working head shown in FIG. 5 as comprising saw blades 164, 166, whereupon horizontal roller 185 will commence to engage upper surface 186 of masonry unit 12. Movement of masonry unit 12 will continue in the direction of Arrow C and eventually remove upper surface 186 thereof from below restraining strap 183. Nevertheless, during this period horizontal roller 185 will maintain the stability of masonry unit 12 on support plates 40 while the abrasion treatment of masonry unit 12 is completed. The diameter of horizontal roller 185 must, accordingly, be of such a size as to permit the lower surface of horizontal roller 185 which opposes support plates 40 to extend a distance below processing tray 102*a* through opening 160A therein to encounter upper surface 186 of masonry unit 12.

Nevertheless, the height of masonry units 12 before processing is not always absolutely constant. Accordingly, in another aspect of the present invention, the work piece stabilization means of apparatus 10 is provided with an attachment means for securing stabilization rack 180 to processing tray 102*a* and at the same time urging horizontal roller 185 to bear against the top of masonry unit 12 moving past the processing station of apparatus 10. As shown in FIG. 5, by way of example, and not limitation, a spring-tensioning mount 188 secures each corner of stabilization rack 180*a* to processing tray 102*a*.

At each spring-tensioning mount 188, a mounting flange 190 extends laterally outwardly from stabilization rack 180*a* and has formed therethrough a first mounting eye 192. A second mounting eye 194 is formed through processing tray 102*a* at a location opposite first mounting eye 192, and a threaded bolt 196 is disposed through first and second mounting eyes 192, 194, respectively. A nut 198 is threaded onto the free end of threaded bolt 196 with a coil spring 200 disposed in compression about the shaft of bolt 196 intermediate nut 198 and the head of threaded bolt 196. An assembled view of these components of the spring-tensioning mounts can be obtained in FIG. 6.

While a number of arrangements of such structures will successfully bring horizontal roller 185 to bear against upper surface 186 of masonry unit 12 and accommodate for variations in the height of upper surface 186 from support plates 40, where stabilization rack 180 is disposed on the side of processing tray 102*a* opposite from the conveyor path of apparatus 10, coil spring 200 is generally disposed between nut 198 and the lower side of stabilization tray 102*a* Various washers, such as washer 202 can be provided in a structure to facilitate successful functioning. With the head of bolt 196 drawn downwardly against the top surface of mounting flange 190 by the action of compressed coil spring 200, stabilization rack 180*a* will be at the lowest possible height thereof above support plates 40 with the lower surface of mounting flange 190 bearing against the upper surface of processing tray 102*a* when no masonry unit 12 is beneath roller 185. When masonry block 12 does, however, enter the processing station of apparatus 10, the action of the conveyor belt of apparatus 10 including pusher stop 90 will force masonry block 12 under restraining strap 183 and then under horizontal roller 185 displacing the end of stabilization rack 180*a* in which that roller is mounted upwardly against the biased force of coil springs 200 in the spring-tensioning mounts at that end of stabilization rack 180*a*.

FIG. 6 illustrates a second embodiment of a working head and structures associated therewith for use in an apparatus, such as apparatus 10. A masonry unit 12 is seen there upheld by support plates 40 moving along the conveyor path of apparatus 10 in a direction shown by Arrow C. A hood 100*a* over the site where masonry unit 12 is subjected to abrasion treatment has been broken away to reveal a processing tray 102*b* and a stabilization rack 180*b* mounted thereto by spring-tension mounts 188, all largely configured similarly to the corresponding structure as described and disclosed in relation to FIG. 5.

In FIG. 6, however, the working head of apparatus 10 takes the form of a cylindrical drum 210 rotatably mounted in processing tray 102*b* above and normal to the conveyor path of apparatus 10 and parallel to support plates 40. Typically, cylindrical drum 210 comprises a hollow cylindrical core 212 having a cap 214 at each end thereof for mounting cylindrical drum 210 to axle 168. A pattern of abrasive 216, such as natural or synthetic diamonds, is mounted in a matrix on the exterior of cylindrical bore 212. Preferably the pattern of abrasive 216 takes the form of a plurality of tracks equally spaced about the circumference of core 212 encircling core 212 at an acute angle to the axis thereof.

It has been found that the described configuration of a cylindrical working head is extremely effective in grinding and polishing to a finish the faces of masonry building material. Cylindrical drum 210 is driven in rotation in the direction shown, for example, by Arrow D through drive wheel 172 by working head drive motor 140 shown in FIGS. 1 and 2.

Masonry unit 12 advances past cylindrical drum 210 receiving the abrasion treatment intended therefore. In order to stabilize the position of masonry unit 12 on support plates 40 during this process a first pair of horizontal rollers 218 and a second pair of horizontal rollers 220 are rotatably mounted in stabilization rack 180*b*. Horizontal rollers 218 are of a relatively small diameter and are disposed in close proximity parallel relation to each other on the side of cylindrical drum 210 that first encounters a masonry unit 12 being moved continuously past processing station 62 of apparatus 10. It has been found that a pair of rollers located close one to another provides for enhanced stabilization of a work piece, such as masonry unit 12, than will a single large roller or a pair of widely displaced rollers. Similarly and accordingly, horizontal rollers 220 are of relatively small diameter disposed in close parallel proximity to each other on the side of cylindrical drum 210 opposite from the pair of horizontal rollers 218. The manner in which horizontal rollers 218, 220 serve to stabilize a work piece receiving abrasion treatment from cylindrical drum 210 has already been described in relation to horizontal rollers 182, 184 shown in FIG. 5.

Optionally, at the leading edge 122 of processing tray 102*b* which first encounters masonry units 12 transported along the conveyor path of apparatus 10 is optionally provided a safety sensor 224. It is the function of safety sensor 224 to detect masonry units 12 being transported on support plates 40 that exceed a predetermined safe height in order to be processed by apparatus 10. Upon detecting the presence of such an oversized masonry unit 12, safety sensor 224 disengages the motive effect of conveyor belt drive motor 68 and sounds an alarm to secure operator attention.

Hood 100*a* shown in FIG. 6 has been provided with a vent 126 through which a vacuum evacuation system can remove from the immediate vicinity of cylindrical drum 210 dust particles produced by the abrasion treatment of masonry unit 12. Where such a vacuum evacuation system is in operation, it will generally be the case that the fluid delivered under pressure into hood 100*a* by piping 148*b* will be a gas rather than a liquid. In FIG. 6 piping 148*b* is provided with nozzles 228 which direct the fluid therein onto masonry unit 12 at a point along the conveyor path of apparatus 10 that follows its abrasion treatment. Additional nozzles 230 direct the fluid from piping 148*b* directly onto the surface of cylindrical drum 210 at a location immediately adjacent to the point of contact between the surface of cylindrical drum 210 and masonry unit 12. More advantageously, nozzles 230 direct such fluid onto a location on the surface of cylindrical drum 210 which immediately follows contact of the surface of cylindrical drum 210 with masonry unit 12 relative to the direction of rotation of cylindrical drum 210 shown by Arrow D. This cools cylindrical drum 210 and removes cuttings therefrom to prevent their impacting into abrasive 216 and reducing its effectiveness.

FIG. 7 depicts yet another configuration of a processing tray 102c and a stabilization rack 180c used in an apparatus 10 according to the teachings of the present invention. Similar structures to those described previously will not be detailed, except to note that in the structure disclosed in FIG. 7 a pair of cylindrical drums 210a, 210b are employed rotatably mounted on axles 168 by way of bushings 170 to processing tray 102c.

Correspondingly, stabilization rack 180c rotatably mounts three pairs of horizontal rollers, 218, 220, and 240. As in relation to the horizontal rollers described in FIG. 6, horizontal rollers 218 are the first of the rollers to encounter a masonry unit (not shown) moving in its intended direction through processing station 62 of apparatus 10. Such a masonry unit will next encounter cylindrical drum 210a and receive a first abrasion treatment therefrom. Thereafter, horizontal rollers 220 commence to assist horizontal rollers 218 in sustaining the orientation of the work piece, while it passes onto its second abrasion treatment at cylindrical drum 210b. Optionally, drum 210a can be provided with a pattern of abrasive, such as natural or synthetic diamonds, which effects a coarser bite in the abrasion treatment provided than does the synthetic diamond matrix on cylindrical drum 210b.

As a masonry unit completes its second abrasion treatment at cylindrical drum 210b, the third pair of horizontal rollers 240 begin to maintain the masonry unit in a stable position on conveyor belt 34 as it is being transported toward output station 64 of apparatus 10.

Even after passing third pair of horizontal rollers 240, a work piece may receive further abrasion treatment from one or a pair of relatively smaller grinding wheels 242 positioned under hood 100b. Grinding wheels 242 provide masonry units with architecturally decorative relief, such as curved corners, beveled edges, or grooves of varying shapes. Grinding wheels 242 are rotated by grinding motors 244 which are mounted by way of brackets 246 and plate 248 to processing tray 102c at apertures 250.

The extraction system shown in FIG. 7 provides a fluid under pressure by way of piping 148c and nozzles 252 to the surface of cylindrical drums 210a, 210b. In addition, nozzles 254 remove debris from the surface of the work piece following each stage of its processing by abrasion treatment. Finally, nozzles 256 also direct the fluid in piping 148c onto grinding wheels 242 for cleaning and cooling.

The apparatus disclosed is thus a production line type continuous feed device for producing low cost finished masonry building material from masonry units. The apparatus features drive mechanisms of adjustable speed and relatively interchangeable forms of working heads using alternative processing tray assemblies as shown and described in the various drawings, such as saws and cylindrical drums which are specifically suited to the relatively soft coarse material being processed. Cooling and grinding chip evacuation can be effected flexibly through the use of water, gas, or other liquid under pressure. The apparatus disclosed has a high volume throughput with reduced down time. A high quality consistently sized and polished product is the resulting output.

The invention also contemplates a method for converting masonry units 12 into finished masonry building materials 14 comprising the steps of loading masonry units 12 at an input station 60 onto conveyor belt 34 supported along a conveyor path from input station 60 to an output station 64 for the finished masonry building materials 14. Thereafter, conveyor belt 34 is advanced to transport masonry units 12 along the conveyor path. The movement of masonry blocks 12 is circumscribed as those blocks are transported along the conveyor path, and masonry units 12 are restrained against conveyor belt 34 as masonry units 12 are moved continuously past processing station 62 located along the conveying path between the input and the output stations 60, 64, respectively. The method further comprises the step of rotating a work head located at processing station 62 that is capable of subjecting masonry blocks 12 to abrasion treatment for producing therefrom finished masonry building materials 14 of a predetermined size and surface finish quality. Finally, the method comprises the step of moving masonry blocks 12 continuously past processing station 62 to subject same to abrasion treatment by the rotation working head.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Patent is:

1. An apparatus for processing masonry units into finished masonry building materials, said apparatus comprising:

a. a frame;

b. a chain movably supported from said frame along a conveyor path from an input station for the masonry units to an output station for the finished masonry building materials, said chain supporting and transporting the masonry units along said conveyor path and being comprised of a plurality of links connected in sequence to form an endless loop; and c. an interchangeable processing tray assembly supported from said frame above and substantially parallel to said conveyor path, said processing tray assembly comprising tray means for supporting at least one of a plurality of different types of working heads rotatable mounted thereon, and further comprising a stabilization rack means for supporting roller means for vertically stabilizing said work piece, and attachment means for mounting said stabilization rack means to said processing tray means, in a spring-biased manner, and said working head effecting abrasion treatment of the masonry units as the masonry units supported by said chain are moved continually past said working head, said abrasion treatment producing from the masonry units finished masonry building materials of a predetermined size and surface finish quality.

2. An apparatus as recited in claim 1, further comprising a lateral work piece stabilization means for preventing lateral deviation of each of the masonry units moving past said processing station when the masonry unit is subjected to said abrasion treatment by said working head.

3. An apparatus as recited in claim 2, wherein said lateral work piece stabilization means urges each of the masonry units into a fixed line of travel parallel said conveyor path when the masonry unit is subjected to said abrasion treatment.

4. An apparatus as recited in claim 3, wherein said lateral work piece stabilization means comprises:

a. a lateral stabilization rack disposed generally parallel to said conveyor path at the side of each of the masonry units when the masonry unit is subjected to said abrasion treatment;

b. a roller rotatably mounted on said lateral stabilization rack with the axis thereof being vertically disposed; and c. horizontal attachment means for securing said lateral stabilization rack to said frame and urging said roller mounted in said lateral stabilization rack against the side of each of the masonry units when the masonry unit is subjected to said abrasion treatment.

5. An apparatus as recited in claim 4, wherein said horizontal attachment means comprises a horizontal spring-tensioning mount between said lateral stabilization rack and said frame.

6. An apparatus as recited in claim 4, wherein said horizontal attachment means comprises:

a. a support sleeve rigidly secured to said frame;

b. a rod rigidly secured to said lateral stabilization rack and slidably disposed through said support sleeve;

c. means disposed on said rod on the side of said support sleeve opposite from said lateral stabilization rack for limiting the extent of movement of said rod and said lateral stabilization rack toward said conveyor path; and d. a coil spring disposed in compression about said rod intermediate said support sleeve and said lateral stabilization rack.

7. An apparatus as recited in claim 4, further comprising a plurality of rollers of relatively small diameter rotatably mounted parallel to each other on said lateral stabilization rack with the axes thereof being vertically disposed.

8. An apparatus as recited in claim 3, wherein said lateral work piece stabilization means comprises:

a. a first lateral stabilization rack disposed generally parallel to said conveyor path at the side of each of the masonry units when the masonry unit is subjected to said abrasion treatment;

b. a first roller rotatably mounted on said first lateral stabilization rack with the axis thereof being vertically disposed;

c. a first horizontal attachment means for securing said first lateral stabilization rack to said frame and urging said first roller mounted in said first lateral stabilization rack against the side of each of the masonry when the masonry unit is subjected to said abrasion treatment;

d. a second lateral stabilization rack on the opposite side of said conveyor path from said first lateral stabilization rack, said second lateral stabilization rack being disposed generally parallel to said conveyor path at the side of each of the masonry units when the masonry unit is subjected to said abrasion treatment;

e. a second roller rotatably mounted on said second lateral stabilization rack with the axis thereof being vertically disposed; and f. a second horizontal attachment means for securing said second lateral stabilization rack to said frame and urging said second roller mounted in said second lateral stabilization rack against the side of each of the masonry units when the masonry unit is subjected to said abrasion treatment.

9. An apparatus as recited in claim 8, wherein said first and second attachment means each comprise horizontal spring-tensioning mounts between individual of said first and second lateral stabilization frames and said first and said second lateral stabilization racks, respectively.

10. An apparatus as recited in claim 8, wherein said first horizontal attachment means comprises:

a. a support sleeve rigidly secured to said frame;

b. a rod rigidly secured to said first lateral stabilization rack and slideably disposed through said support sleeve;

c. means disposed on said rod on the side of said support sleeve opposite from said first lateral stabilization rack for limiting the extent of movement of said rod and said first lateral stabilization rack toward said conveyor path; and d. a coil spring disposed in compression about said rod intermediate said support sleeve and said first lateral stabilization rack.

11. An apparatus as recited in claim 8, wherein said second horizontal spring-tensioning mount comprises:

a. a support sleeve rigidly secured to said frame;

b. a rod rigidly secured to said second lateral stabilization rack and slideably disposed through said support sleeve;

c. means disposed on said rod on the side of said support sleeve opposite from said second lateral stabilization rack for limiting the extent of movement of said rod and said second lateral stabilization rack toward said conveyor path; and d. a coil spring disposed in compression about said rod intermediate said support sleeve and said second lateral stabilization rack.

12. An apparatus as recited in claim 1, wherein said roller means for vertical work piece stabilization comprising:

a. a vertical stabilization rack supported from said processing tray and disposed generally parallel to the top surface of each of the masonry units when the masonry unit is subjected to said abrasion treatment;

b. a horizontal roller rotatably mounted on said stabilization rack with the axis thereon disposed normal to said conveyor path; and c. vertical attachment means for securing said vertical stabilization rack to said processing tray and urging said horizontal roller against the top surface of each of the masonry units when the masonry unit is subjected to said abrasion treatment.

13. An apparatus as recited in claim 12, wherein said roller means for vertical work piece stabilization further comprises a restraining strap supported from said processing tray parallel to said conveyor path in close proximity to the top surface of the masonry units moving continuously past said processing station.

14. An apparatus as recited in claim 13, wherein said restraining strap is at least partially disposed on the same side of said working head as said input station.

15. An apparatus as recited in claim 12, wherein said vertical attachment means comprises a vertical spring-tensioning mount between said vertical stabilization rack and said processing tray.

16. An apparatus as recited in claim 12, wherein said roller means for vertical work piece stabilization further comprises:

a. a first mounting eye formed through said vertical stabilization rack;

b. a second mounting eye formed through said processing tray at a location opposite said first mounting eye;

c. a threaded bolt disposed through said first and second mounting eyes;

d. a nut threaded onto the end of said bolt opposite the head thereof side; and e. a coil spring disposed in compression about said bolt intermediate the head thereof and said nut.

17. An apparatus as recited in claim 16, wherein said vertical stabilization rack is disposed on the side of said processing tray opposite from said conveyor path, and said coil spring is disposed between said nut and said vertical stabilization rack.

18. An apparatus as recited in claim 1, wherein said roller means for vertical work piece stabilization comprises:

a. a vertical stabilization rack supported from said processing tray and disposed generally parallel to the top surface of each of the masonry units when the masonry unit is subjected to said abrasion treatment;

b. a first pair of horizontal rollers of relatively small diameter disposed parallel to each other and rotatably mounted on said vertical stabilization rack with the axes thereof disposed normal to said conveyor path; and c. vertical attachment means for securing said vertical stabilization rack to said processing tray and urging said pair of horizontal rollers against the top surface of each of the masonry units when the masonry unit is subjected to said abrasion treatment.

19. An apparatus as recited in claim 18, wherein said first pair of horizontal rollers are disposed in close proximity to each other on the same side of said working head.

20. An apparatus as recited in claim 19, wherein said roller means for vertical work piece stabilization further comprises a second pair of horizontal rollers of relatively small diameter disposed parallel to each other and to said first pair of horizontal rollers, said second pair of horizontal rollers being rotatably mounted on said vertical stabilization rack normal to said conveyor path on the side of said working head opposite from said first pair of horizontal rollers.

21. An apparatus as recited in claim 1, wherein said working head comprises first and second axially parallel horizontal cylindrical drums disposed above said conveyor path at distinct points therealong, and said roller means for vertical work piece stabilization comprises:

a. a vertical stabilization rack supported from said processing tray and disposed generally parallel to the top surface of each of the masonry units when the masonry unit is subjected to said abrasion treatment;

b. first, second, and third pairs of parallel horizontal roller of relatively small diameter rotatably mounted on said vertical stabilization rack normal to said conveyor path and parallel to each other, said second pair of horizontal rollers being located between said first and second cylindrical drums, said first pair of horizontal rollers being disposed on the side of said first cylindrical drum opposite from said second pair of horizontal rollers, and said third pair of horizontal rollers being disposed on the side of said second cylindrical drum from said second pair of horizontal rollers; and c. a vertical spring-tensioning mount between said horizontal stabilization rack and said processing tray.

22. An apparatus as recited in claim 1, further comprising a safety sensor located between said input station and said processing station to detect masonry units being transported by said chain that exceed a predetermined height.

23. An apparatus for processing memory units into finished masonry building materials, said apparatus comprising:

a. a frame;

b. a first chain movably supported from said frame along a conveyor path from an input station for the masonry units to an output station for the finished masonry building materials, said first chain comprising a plurality of links connected in sequence to form an endless loop;

c. a plurality of support plates secured individually to links of said first chain, said support plates upholding the masonry units when the masonry units are being transported along said conveyor path;

d. chain drive means for advancing said first chain along said conveyor path;

e. processing means located along said conveyor path for subjecting the masonry units to abrasion treatment as the masonry units upheld on said support plates are moved continuously past said processing means, said processing means comprising an interchangeable processing tray assembly supported from said frame above and substantially parallel to said conveyor path, said processing tray assembly comprising tray means for supporting at least one of a plurality of different types of working heads rotatably mounted thereon, and further comprising a stabilization rack means for supporting roller means for vertically stabilizing said work piece, and attachment means for mounting said stabilization rack means to said processing tray means in a spring-biased manner, and said working head effecting abrasion treatment of the masonry units as the masonry units supported by said chain are moved continually past said working head, the location of said processing means defining a processing station along said conveyor path, said abrasion treatment producing from the masonry units finished masonry building materials of a predetermined size and surface finish quality; and f. height-adjustment means for selectively varying the height of said processing means above said support plates, said height adjustment means comprising a plurality of jacks upholding said processing means and synchronizing means for effecting simultaneous operation of said plurality of jacks.

24. An apparatus as recited in claim 23, wherein said processing means comprises:

a. a rotatable working head for subjecting the masonry units to said abrasion treatment;

b. working head drive means for rotating said working head; and c. work piece stabilization means for restraining each masonry block on said support plates as the masonry block is moved continuously past said processing means and is subjected to said abrasion treatment by said working head.

25. An apparatus as recited in claim 24, wherein said working head comprises a cylindrical drum disposed apart from and normal to said conveyor path parallel to said support plates at said processing station.

26. An apparatus as recited in claim 25, wherein said cylindrical drum comprises:

a. a hollow cylindrical core;

b. an abrasive mounted in a matrix on the exterior of said core; and c. a cap at each end of said cylindrical core for mounting said cylindrical drum to an axle.

27. An apparatus as recited in claim 26, wherein said abrasive comprises a track of diamonds encircling said core at an acute angle to the axis thereof.

28. An apparatus as recited in claim 26, wherein said abrasive comprises a plurality of tracks of diamonds equally spaced about the circumference of said core and encircling said core at an acute angle to the axis thereof.

29. An apparatus as recited in claim 24, wherein said working head comprises a pair of axially parallel cylindrical drums disposed apart from and normal to said conveyor path parallel to said support plates at said processing station.

30. An apparatus as recited in claim 29, wherein said pair of drums comprises a first drum and a second drum, said first drum being located closer to said input station than said second drum and having a coarser bite than said second drum.

31. An apparatus as recited in claim 24, wherein said working head comprises a saw blade disposed with the axis thereof normal to said conveyor path and parallel to said support plates at said processing station.

32. An apparatus recited in claim 24, wherein said working head comprises a pair of parallel saw blades, spaced apart a distance corresponding to a predetermined dimension of the finished masonry building materials, the axes of said saw blades being parallel to said support plates and normal to said conveyor path at said processing station.

33. An apparatus as recited in claim 24, wherein said working head comprises a grinding wheel positioned to provide the masonry units with architecturally decorative relief.

34. An apparatus as recited in claim 24, wherein said processing means further comprises a processing tray supported from said frame at said processing station above and parallel to said support plates at a predetermined distance therefrom, said working head being mounted to said processing tray, whereby at said predetermined distance of said processing frame from said support plates said abrasion treatment to which masonry units are subjected conforms the height of the masonry units above said support plates to a dimension suitable to the finished masonry building materials.

35. An apparatus as recited in claim 34, wherein said working head is readily removable from said processing tray.

36. An apparatus as recited in claim 23, wherein each of said jacks comprises:

a. a threaded shaft mounted between said frame and said processing tray and rotatable to vary the separation therebetween; and b. means for rotating said shaft.

37. An apparatus as recited in claim 36, wherein said means for rotating comprises a handle attached to said shaft.

38. An apparatus as recited in claim 36, wherein said means for rotating comprises a sprocket attached to said shaft.

39. An apparatus as recited in claim 38, wherein said height-adjustment means further comprises a height-adjustment chain forming an endless loop and engaging each of said sprockets.

40. An apparatus as recited in claim 39, wherein said height-adjustment means further comprises a clamp to preclude movement of said height-adjustment chain when said separation of said frame and said processing tray is to remain fixed.

41. An apparatus as recited in claim 34, wherein said height-adjustment means further comprises a clamp corresponding to at least one of said jacks, said clamp being fixedly attached to said processing tray and being configured to selectively effect a non-sliding engagement upon an upright portion of said frame to fix said separation of said frame and said processing tray.

42. An apparatus as recited in claim 41, wherein said clamp comprises:

a. a sleeve supporting said processing tray and slidably mounted about the exterior of a vertical component of said frame;

b. a pressure plate disposed inside said sleeve; and c. a selectively adjustable threaded clamping bolt passing through a threaded aperture in said sleeve opposite said pressure plate.

43. An apparatus as recited in claim 41, wherein said processing means further comprises extraction means for removing cuttings and heat from said processing station.

44. An apparatus for processing masonry units into finished masonry building materials, said apparatus comprising:

a. conveying means for supporting and transporting the masonry units along a conveyor path from an input station for the masonry units to an output station for the finished masonry building materials;

b. an interchangeable processing tray assembly supported above and substantially parallel to said conveying means, said processing tray assembly comprising tray means for supporting at least one of a plurality of different types of working heads rotatably mounted thereon, and further comprising a stabilization rack means for supporting roller means for vertically stabilizing said work piece, and attachment means for mounting said stabilization rack means to said processing tray means in a spring-biased manner, and a working head rotatably mounted on said tray assembly, said working head effecting abrasion treatment of the masonry units as the masonry units supported by said conveying means are moved continuously past said working head, said abrasion treatment producing from the masonry units finished masonry building materials of a predetermined size and surface finish quality, and said stabilization rack means further comprising extraction means mounted thereon for removing cuttings and heat from said working head;

c. drive means for rotating said working head;

d. a hood over said conveyor path at said processing station for confining cuttings produced by said abrasion treatment; and e. height adjustment means for selectively varying the height of said entire modular processing tray assembly above said conveying means, said height-adjustment means comprising a plurality of jacks uphold said tray assembly and synchronizing means for effecting simultaneously operation of said plurality of jacks.

45. An apparatus as recited in claim 44, wherein said extraction means comprises:

a. piping for delivering a fluid under pressure into said hood; and b. nozzles for directing fluid in said piping onto said masonry units at a point along said conveyor path following said abrasion treatment.

46. An apparatus as recited in claim 45, wherein said fluid is water.

47. An apparatus as recited in claim 45, wherein said fluid is a gas.

48. An apparatus as recited in claim 44, wherein said extraction means comprises:

a. piping for delivering a fluid under pressure into said hood; and b. nozzles for directing fluid in said piping onto said working head.

49. An apparatus as recited in claim 48, wherein said fluid is water.

50. An apparatus as recited in claim 48, wherein said fluid is a gas.

51. An apparatus as recited in claim 48, wherein said fluid is directed onto said surface of said working head at a location immediately adjacent to the point of contact between said surface of said working head and the masonry unit.

52. An apparatus as recited in claim 51, wherein said location on said surface of said working head to which said fluid is directed is a location on said surface of said working head which immediately follows contact with the masonry unit relative to the direction of rotation of said working head.

53. An apparatus as recited in claim 44, wherein said hood is provided with a vacuum evacuation system for removing dust particles from the immediate vicinity of said working head.

54. An apparatus for processing masonry units into finished building materials, said apparatus comprising:

a. a frame;

b. first and second parallel chains movably supported from said frame along a conveyor path from an input station for the masonry units to an output station for the finished masonry building materials, said first and second chains each comprising a plurality of links connected to form an endless loop;

c. chain drive means for advancing said first and second chains together to transport the masonry units from said input station to said output station;

d. an interchangeable processing tray assembly supported above and parallel to said conveyor path, said processing tray assembly comprising a processing tray having at least one of a plurality of different types of rotatable working heads mounted thereon and located along said conveyor path above said first and second chains to define a processing station along said conveyor path, said working head effecting abrasion treatment of the masonry units as the masonry units supported by said first and second chains are moved continually past said processing station, said abrasion treatment producing from the masonry units finished masonry building materials of a predetermined size and surface finish quality, said processing tray assembly further comprising:

i. a vertical stabilization rack disposed generally parallel to said processing tray;

ii. a horizontal roller rotatably mounted on said vertical stabilization rack normal to said conveyor path; and iii. vertical attachment means for securing said stabilization rack to said processing tray and urging said roller against the top of each of the masonry units when the masonry unit is subjected to said abrasion treatment.

55. An apparatus as recited in claim 54, wherein said frame further comprises:

a. first and second rails respectively supporting said individual links of said first and second chains at said processing station; and b. a rigidifying brace for said first and second rails to substantially eliminate flexibility therein.

56. An apparatus as recited in claim 54, wherein said apparatus further comprises a hood over said conveyor path at said processing station for confining cuttings produced by said abrasion treatment.

57. An apparatus as recited in claim 54, wherein said apparatus further comprises extraction means for removing cuttings and heat from said processing station.

58. An apparatus as recited in claim 57, wherein said extraction means comprises:

a. piping for delivering a fluid under pressure into said hood; and b. nozzles for directing fluid in said piping to remove cutting from said working head and said masonry units after said abrasion treatment.

59. An apparatus as recited in claim 54, wherein movement of the masonry units laterally of said conveyor path is circumscribed by a pair of guide rails located on opposite sides of said conveyor path, the separation between said guide rails being selectively adjustable to accommodate for transporting masonry units of differing sizes.

60. An apparatus as recited in claim 54, further comprising height-adjustment means for selectively varying the height of said working head above said first and second chains.

61. An apparatus as recited in claim 54, further comprising a. a lateral stabilization rack disposed generally parallel to said conveying path at the side of each of the masonry units when the masonry unit is subjected to said abrasion treatment;

b. a roller rotatably mounted on said lateral stabilization rack with the axis thereof being vertically disposed; and c. horizontal attachment means for securing said lateral stabilization rack to said frame and urging said roller mounted in said lateral stabilization rack against the side of each of the masonry units when the masonry unit is subjected to said abrasion treatment.

* * * * *

UNITED STATES PATENT AND TRADEMARK OFFICE

CERTIFICATE OF CORRECTION

PATENT NO. : 5,085,008

DATED : February 4, 1992

INVENTOR(S) : GILBERT M. JENNINGS et al.

It is certified that error appears in the above-identified patent and that said Letters Patent is hereby corrected as shown below:

Column 2, line 66, after "than" insert --that--
Column 7, line 46, "One embodiment" should be --In one embodiment--
Column 9, line 2, after "upon" insert --which--
Column 9, line 51, after "pair" insert --of--
Column 10, line 13, "Conveyor" should be --conveyor--
Column 10, line 34, after "86" insert --which--
Column 12, line 56, "dive" should be --drive--
Column 13, line 2, "and dust are trained" should be --and dust entrained--
Column 14, line 35, after "of" insert --the--
Column 15, line 6, "rails 260," should be --rails 160,--
Column 16, line 10, delete ","
Column 16, line 60, "opening 160A" should be --opening 162A--
Column 17, line 27, after "tray 102A" insert --.--
Column 19, line 31, "third" should be --the third--
Column 20, line 68, after "parallel" insert --to--
Column 27, line 2, "uphold" should be --upholding--

Signed and Sealed this

Twenty-fourth Day of August, 1993

Bruce Lehman

*Attest:*

BRUCE LEHMAN

*Attesting Officer*

*Commissioner of Patents and Trademarks*